US005961184A

United States Patent [19]

Balderi et al.

[11] Patent Number: 5,961,184

[45] Date of Patent: Oct. 5, 1999

[54] FRAME-TYPE CHAIR

[75] Inventors: Nicola Balderi, Kansas City, Mo.; Paul W. Horner, Overland Park, Kans.; Roger A. Babcock, Oak Grove, Mo.

[73] Assignee: Fixtures Manufacturing Corporation, Overland Park, Kans.

[21] Appl. No.: 08/870,159

[22] Filed: Jun. 6, 1997

[51] Int. Cl.[6] ..... A47C 5/10

[52] U.S. Cl. ..... 297/448.1; 297/440.15; 297/440.21

[58] Field of Search ..... 297/440.21, 440.22, 297/440.15, 440.1, 448.2, 440.24

[56] References Cited

U.S. PATENT DOCUMENTS

| | | | |
|---|---|---|---|
| 2,281,902 | 5/1942 | Witz | 297/440.21 |
| 2,719,579 | 10/1955 | Schaffer | 297/440.15 |
| 2,784,769 | 3/1957 | Fisher | 297/440.15 X |
| 2,955,646 | 10/1960 | Briggs | 297/440.21 |
| 3,245,715 | 4/1966 | Gits | 297/440.21 X |
| 4,305,617 | 12/1981 | Benoit | 297/448.2 |
| 5,123,702 | 6/1992 | Caruso | 297/448.2 X |

*Primary Examiner*—Peter M. Cuomo
*Assistant Examiner*—Stephen Vu
*Attorney, Agent, or Firm*—Mark E. Brown; Litman, Kraai & Brown L.L.C.

[57] ABSTRACT

A frame-type chair includes a frame having a base subframe and a back subframe. A seat is mounted on the base by sockets formed in the seat which receive frame ends in heat-stake and telescopic relationships. A back is mounted on the back subframe and includes sockets which receive back subframe ends in heat-stake relationships. The chair can be provided with a pair of arms or with a tablet arm.

1 Claim, 17 Drawing Sheets

40a
42b
8
44a
12a
42a
40b
2
12e
12
6
28
10a
28c
28d
10c
10b
4
10a
10b
10e
10h
19
10
10g

FRAME-TYPE CHAIR

BACKGROUND OF THE INVENTION

1. Field of the Invention

The present invention relates generally to frame-type chairs, and in particular to a stackable chair with a wire frame which mounts a seat, a back, optional arms and an optimal tablet arm without the need for mechanical fasteners.

2. Description of the Related Art

Chairs are available in a wide range of styles, functional features and prices to meet the requirements of particular applications. For example, places of assembly and meeting facilities often require large numbers of chairs and seating to accommodate events with large audiences. It is often desirable for the chairs used by meeting participants to be portable and relocatable. Another common criteria for meeting facility chairs is that they be foldable or stackable to simplify storage. Thus, meeting facility chairs tend to be relatively lightweight and capable of compact storage in relatively large numbers.

Folding chairs are often used as meeting facility chairs. A common type of folding chair is fabricated from sheet metal and steel tubing and is adapted for folding into a relatively flat storage configuration. However, such folding metal chairs can be uncomfortable, particularly when occupied for long periods of time. Moreover, a folding chair designer's options are somewhat limited because their designs are largely dictated by the folding mechanisms.

Another solution to the problem of storing large numbers of meeting facility chairs is to stack them. Stackable chairs are often fabricated with molded plastic seats and backs fastened on steel frames. Plastic has the advantages of warmth to the touch for greater comfort and a wide range of shapes, textures and colors for aesthetic and style considerations. For example, a relatively lightweight, inexpensive stackable chair is shown in the Polsky U.S. Pat. No. Des. 244,978, and features a one-piece molded plastic seat and back fastened to a trestle-type steel frame. Another advantage of chairs which incorporate plastic seats and backs relates to the flexibility of this material, which can enhance comfort, particularly when a chair is occupied for a long period of time, such as during a long meeting, a lengthy lecture, etc.

Interior designers and furniture specifiers often prefer separate seats and backs for comfort and aesthetic reasons. However, a disadvantage of increasing the number of chair components relates to the requirement of mechanical fasteners for securing the seats and backs on the frames. Such fasteners can increase material and labor costs in manufacture, and can detract from the overall appearance and performance of the chair. Therefore, a need exists for a relatively lightweight, stackable chair with a plastic seat and back which can be mounted on a steel frame without mechanical fasteners. The present invention addresses these objectives. Heretofore there has not been available a stacking chair with the advantages and features of the present invention.

SUMMARY OF THE INVENTION

In the practice of the present invention, a frame-type chair is provided, which includes a frame, a seat and a back. The frame includes a base subframe with opposite frame sides and a back subframe. The seat includes first and second pairs of sockets each having receivers for receiving a respective frame end. The back has a third pair of sockets with receivers for receiving ends of the back subframe. Some of the frame ends can be secured within respective receivers in heat-stake relationships. Frame-type chairs comprising alternative embodiments of the present invention include arms and a tablet arm.

OBJECTS AND ADVANTAGES OF THE INVENTION

The principle objects and advantages of the present invention include: providing a frame-type chair; providing such a chair which is stackable; providing such a chair which is relatively lightweight; providing such a chair with a back and a seat adapted for mounting on a frame without mechanical fasteners; providing such a chair which can include arms; providing such a chair which can include a tablet arm; providing such a chair which is well suited for places of assembly; providing such a chair which can be fabricated from common materials; providing such a chair which is efficient in operation, capable of a long operating life, relatively simple to manufacture and is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
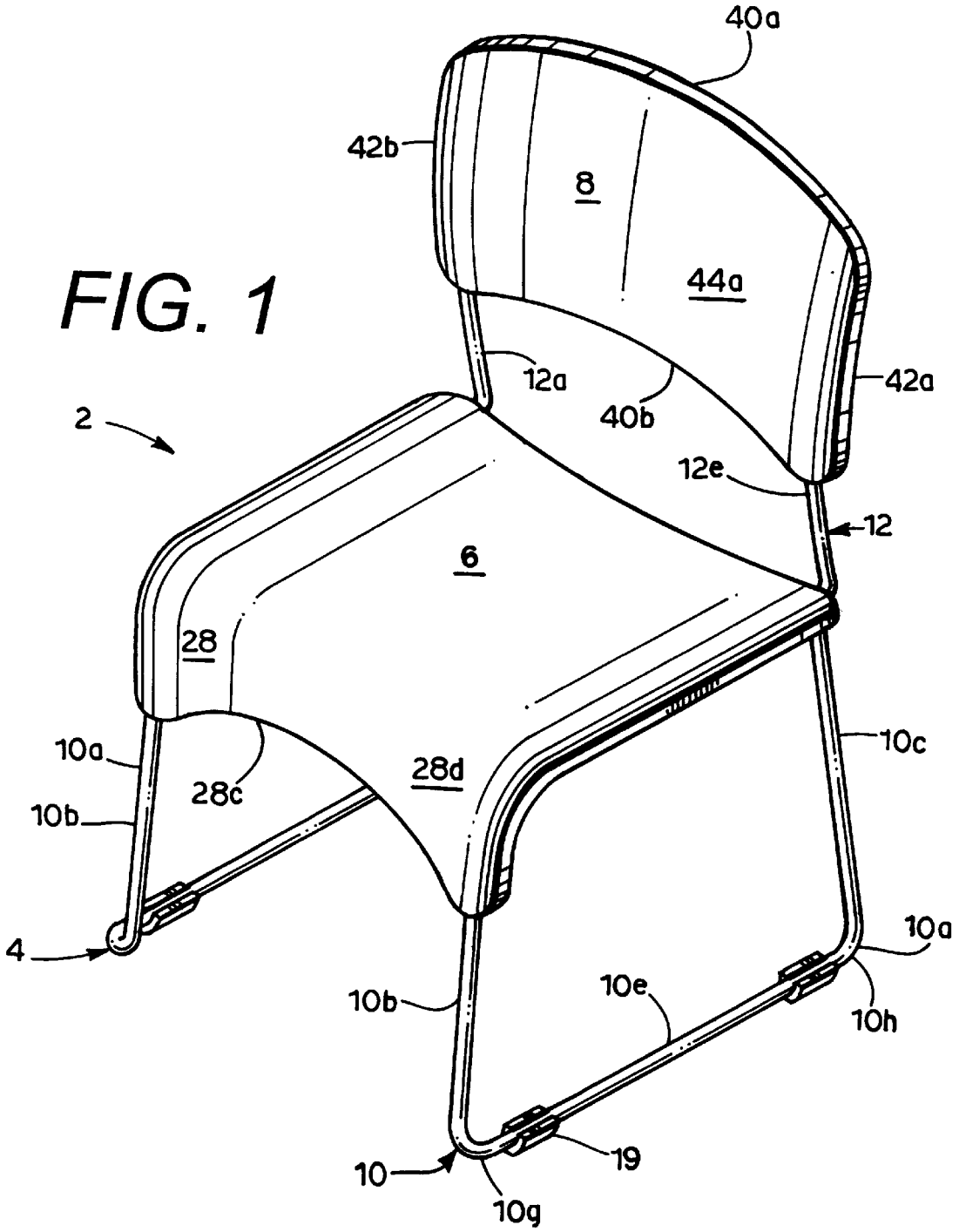
FIG. 1 is an upper, front perspective view of a frame-type chair, embodying the present invention.
Figure 2:
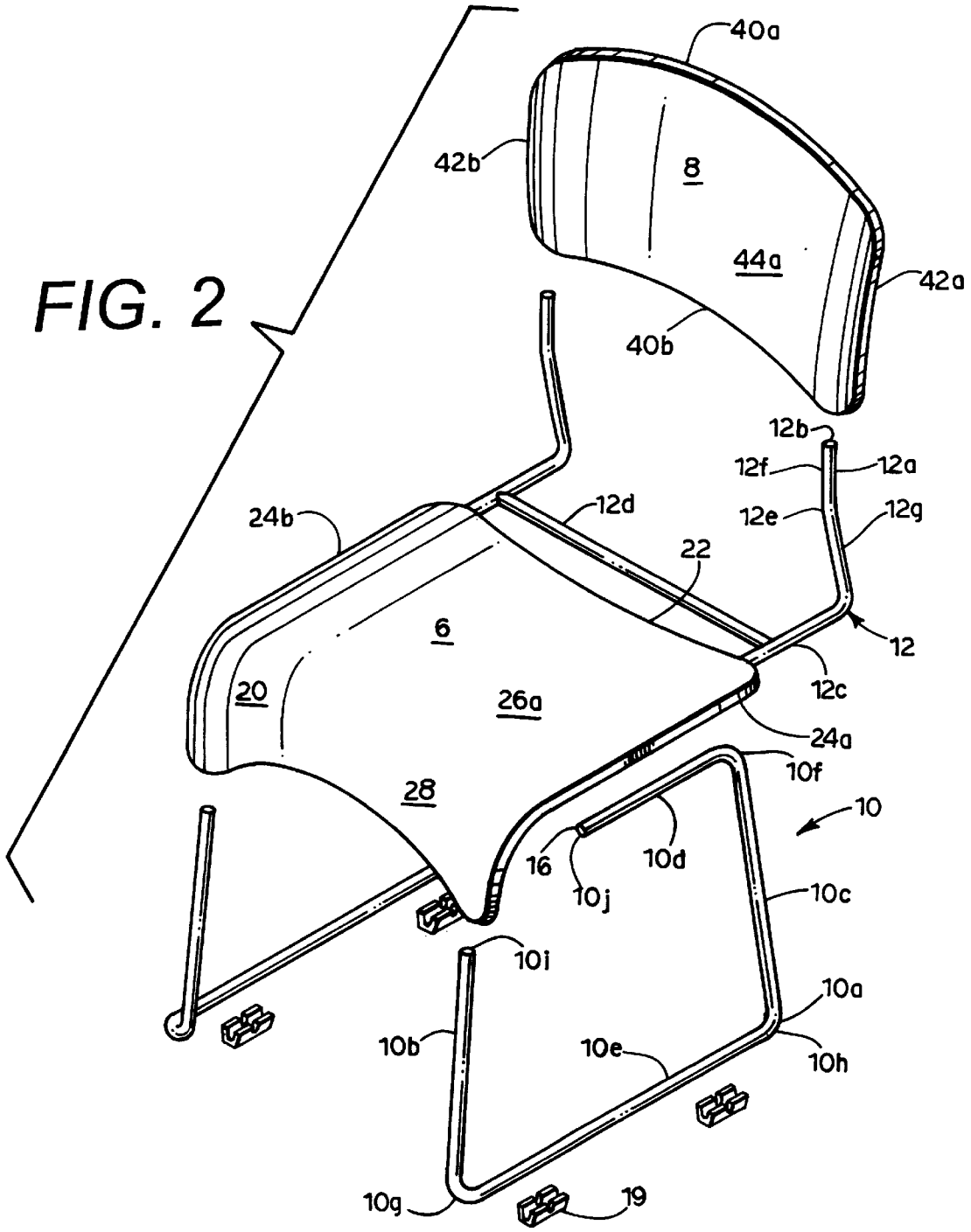
FIG. 2 is an upper, front, exploded perspective view thereof.
Figure 3:
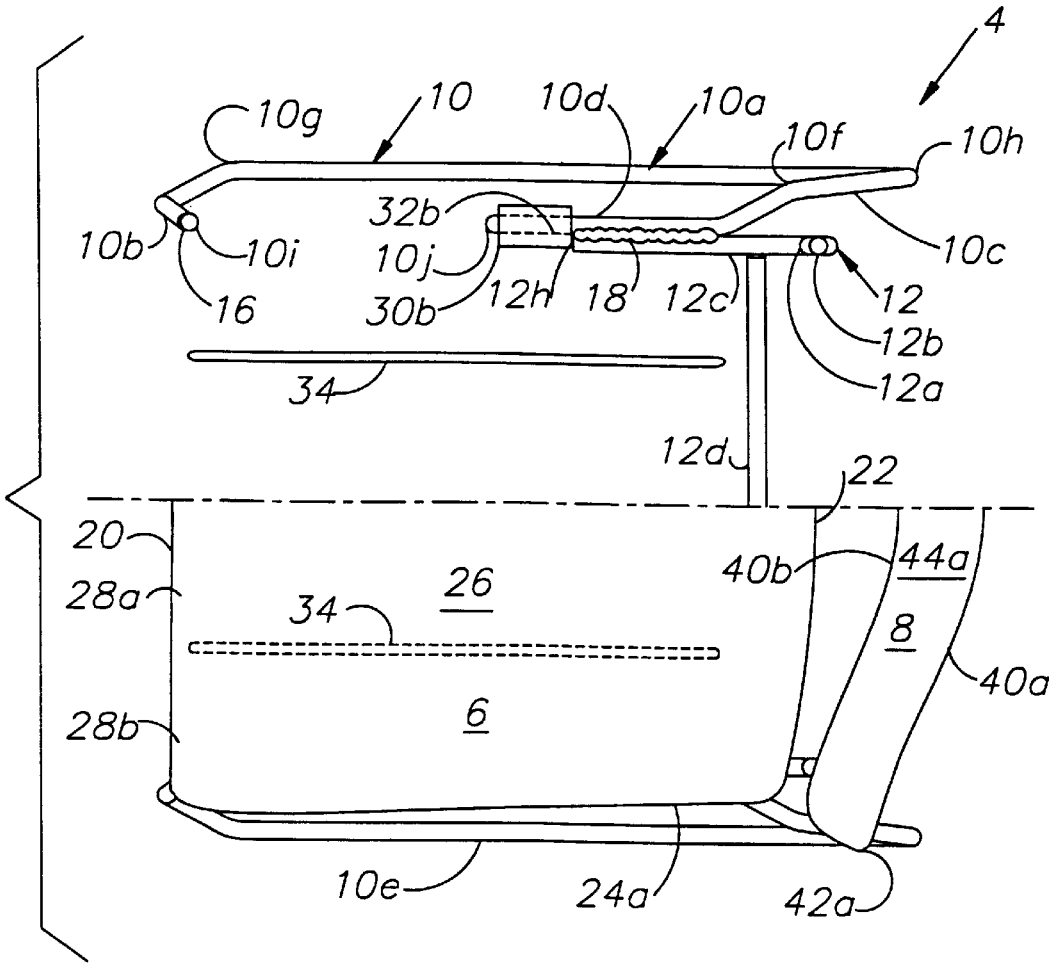
FIG. 3 is a top plan view thereof.
Figure 4:
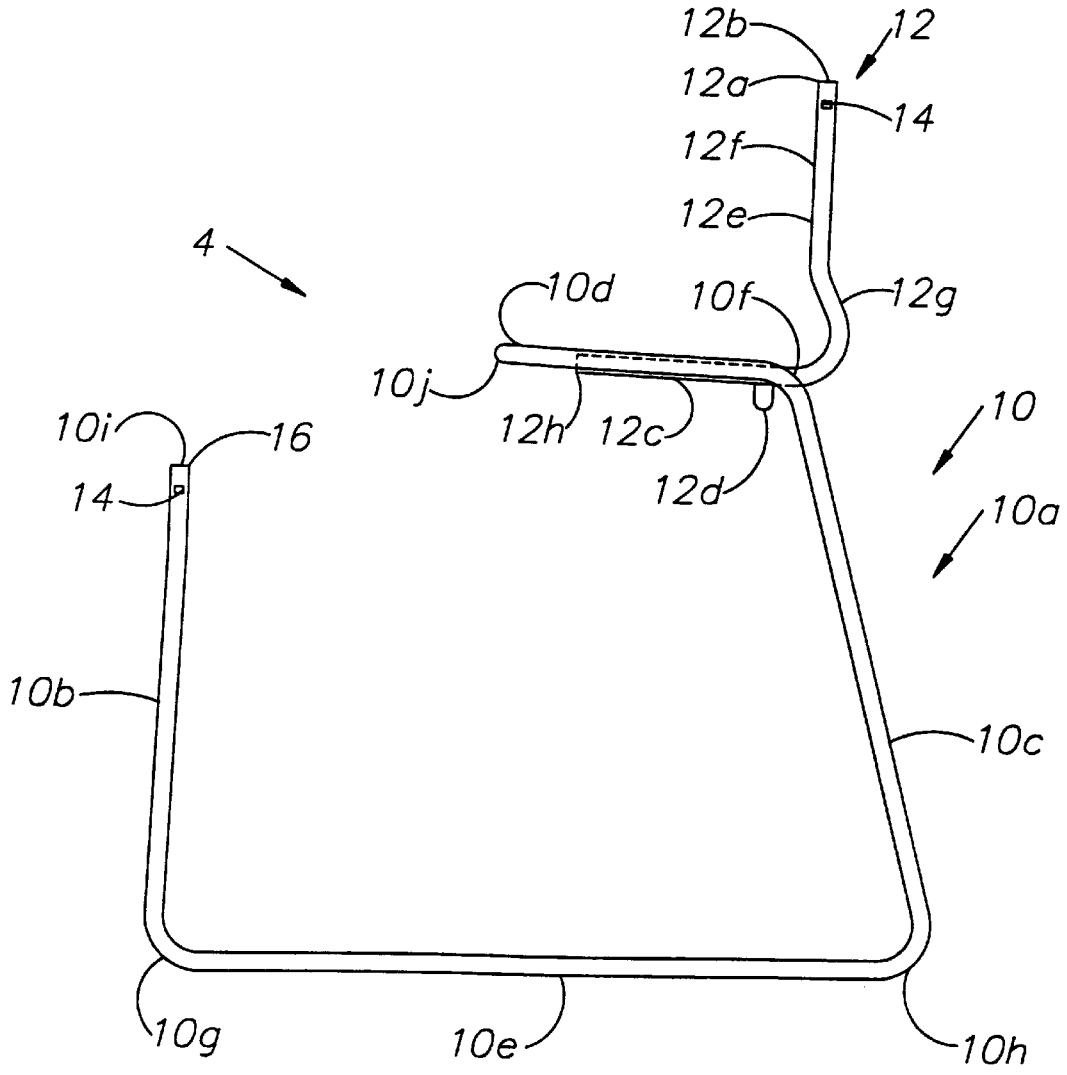
FIG. 4 is a side elevational view of a frame thereof.
Figure 5:
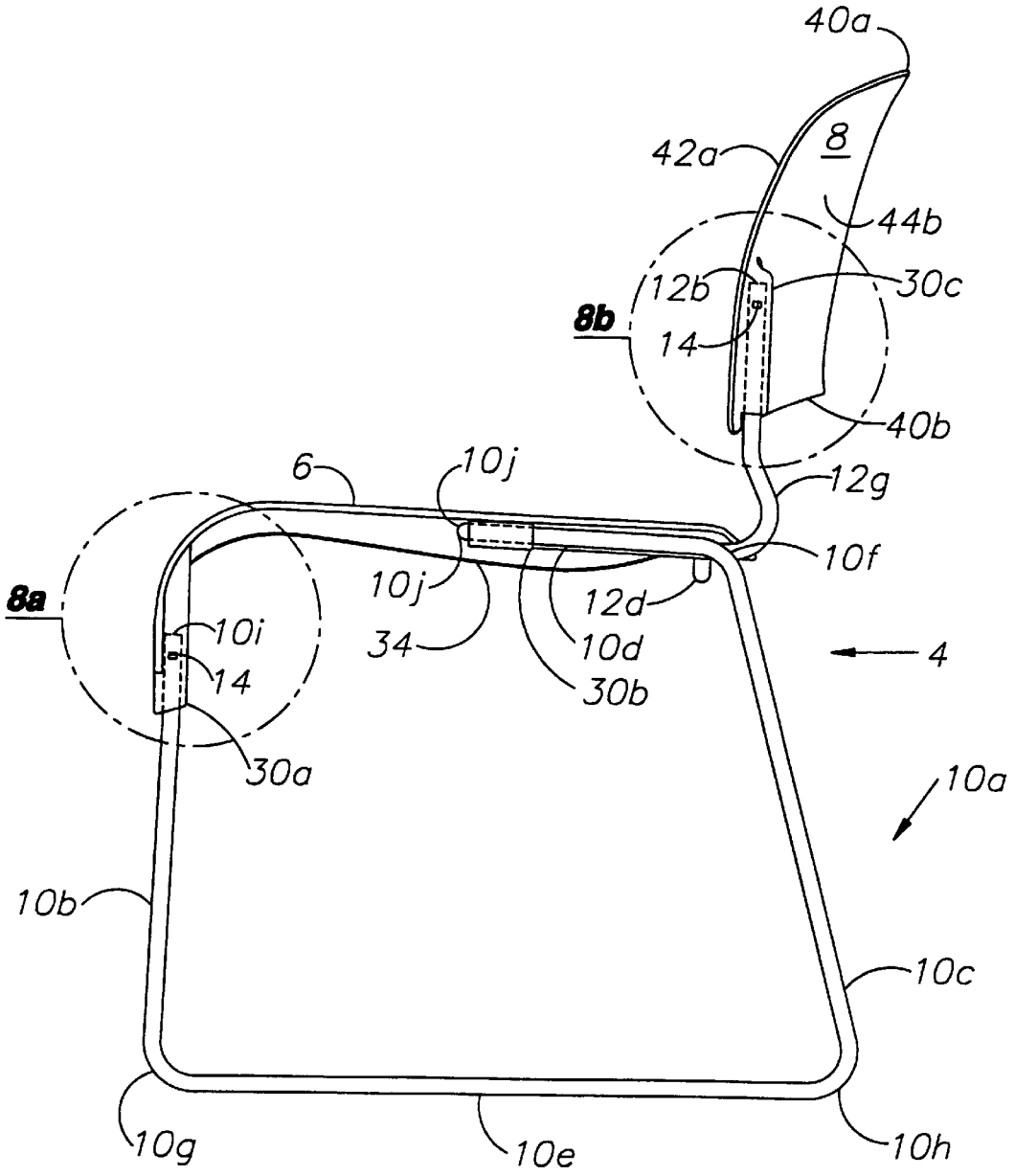
FIG. 5 is a side elevational view thereof.
Figure 6:
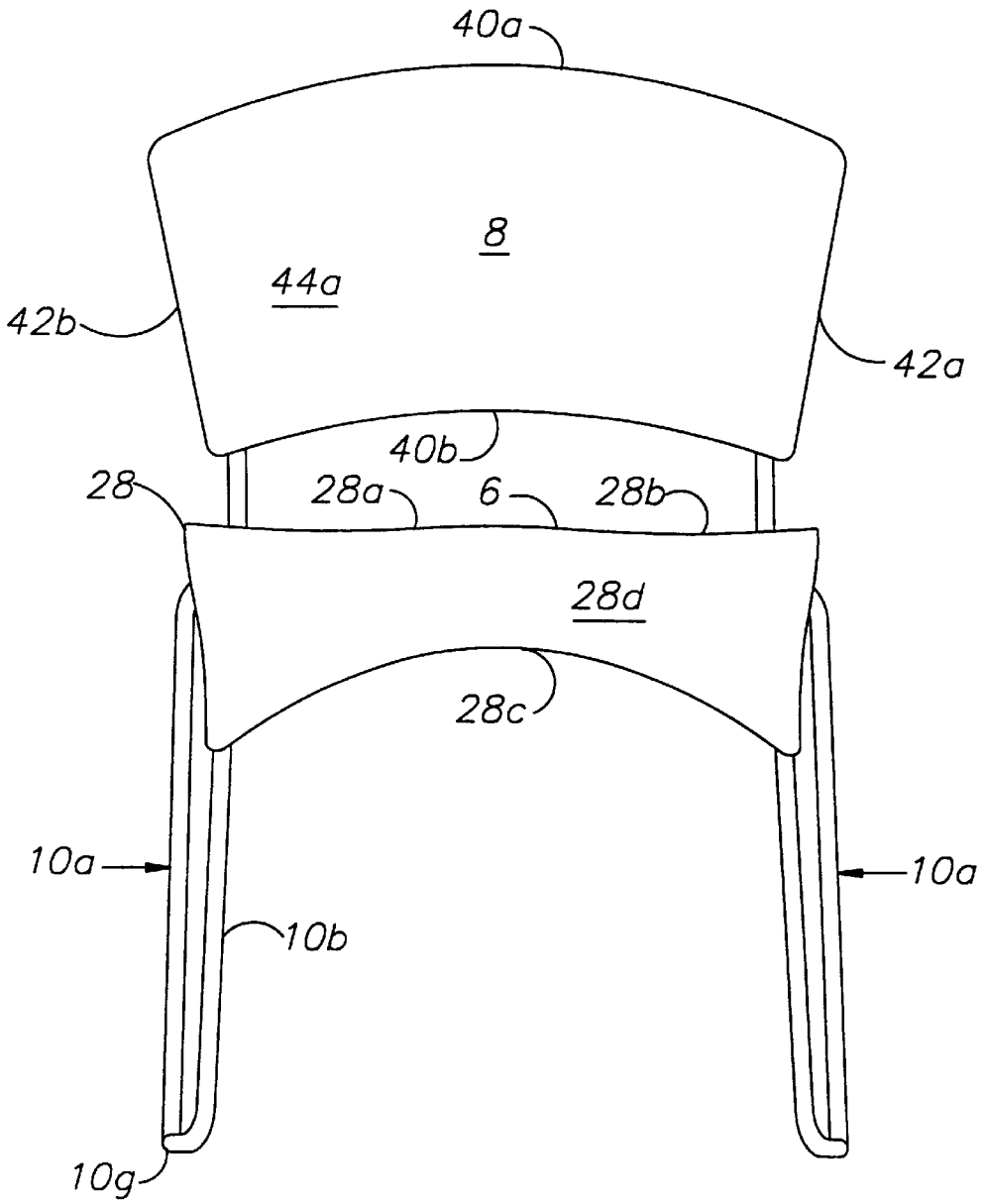
FIG. 6 is a front elevational view thereof.
Figure 7:
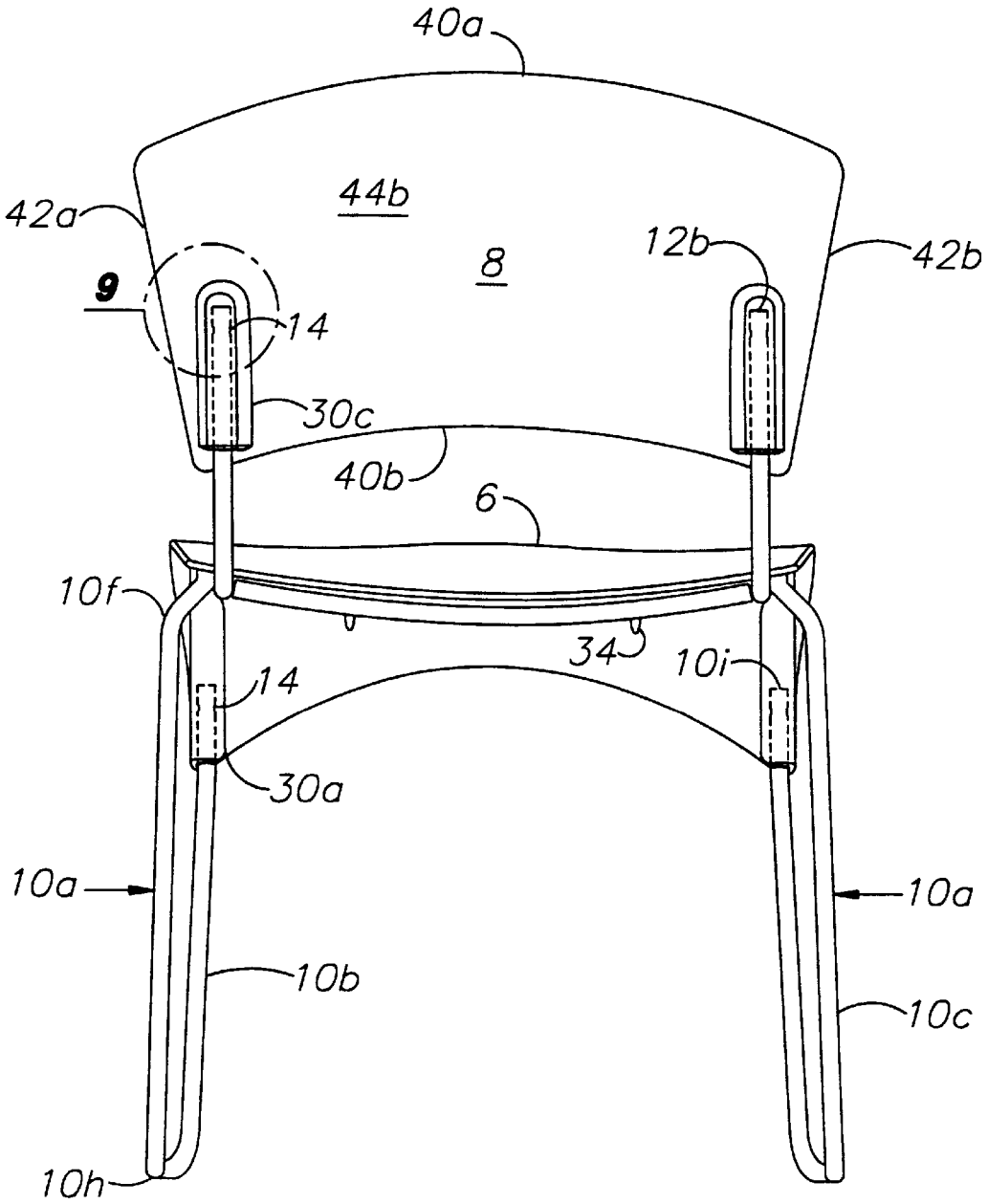
FIG. 7 is a rear elevational view thereof.
Figure 8A:
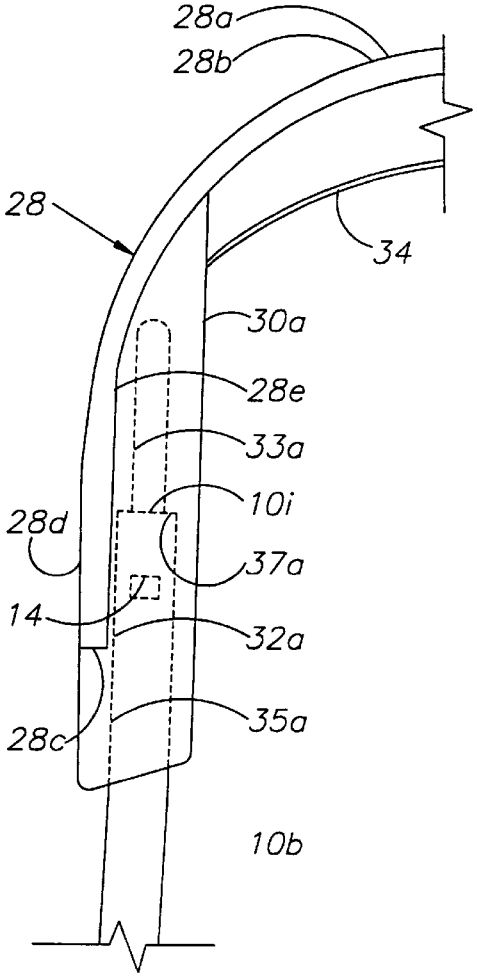
FIG. 8*a* is an enlarged, fragmentary, side elevational view thereof, generally showing the area marked 8*a* in FIG. 5.
Figure 10:
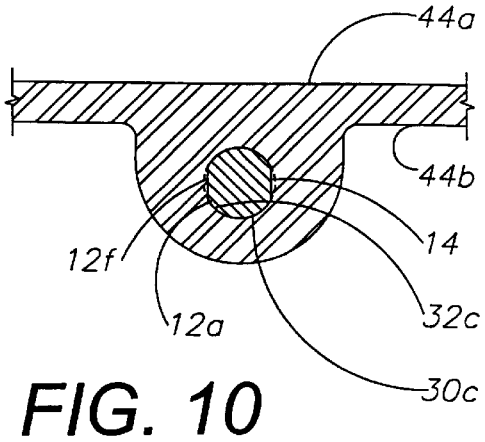
FIG. 10 is an enlarged, fragmentary, horizontal cross-sectional view thereof, taken generally along lines 10—10 in FIG. 9.
Figure 9:
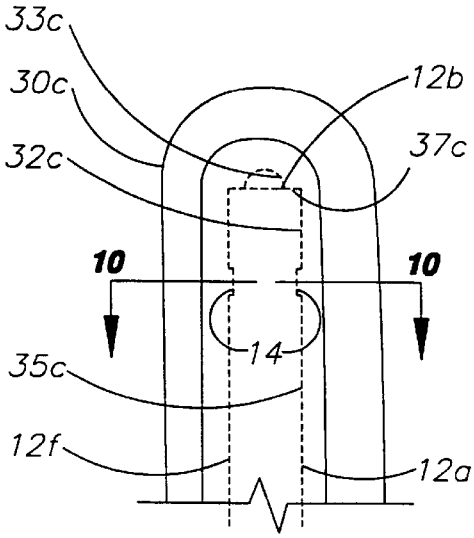
FIG. 9 is an enlarged, rear elevational view thereof, generally showing the area marked 9 in FIG. 7.
Figure 8B:
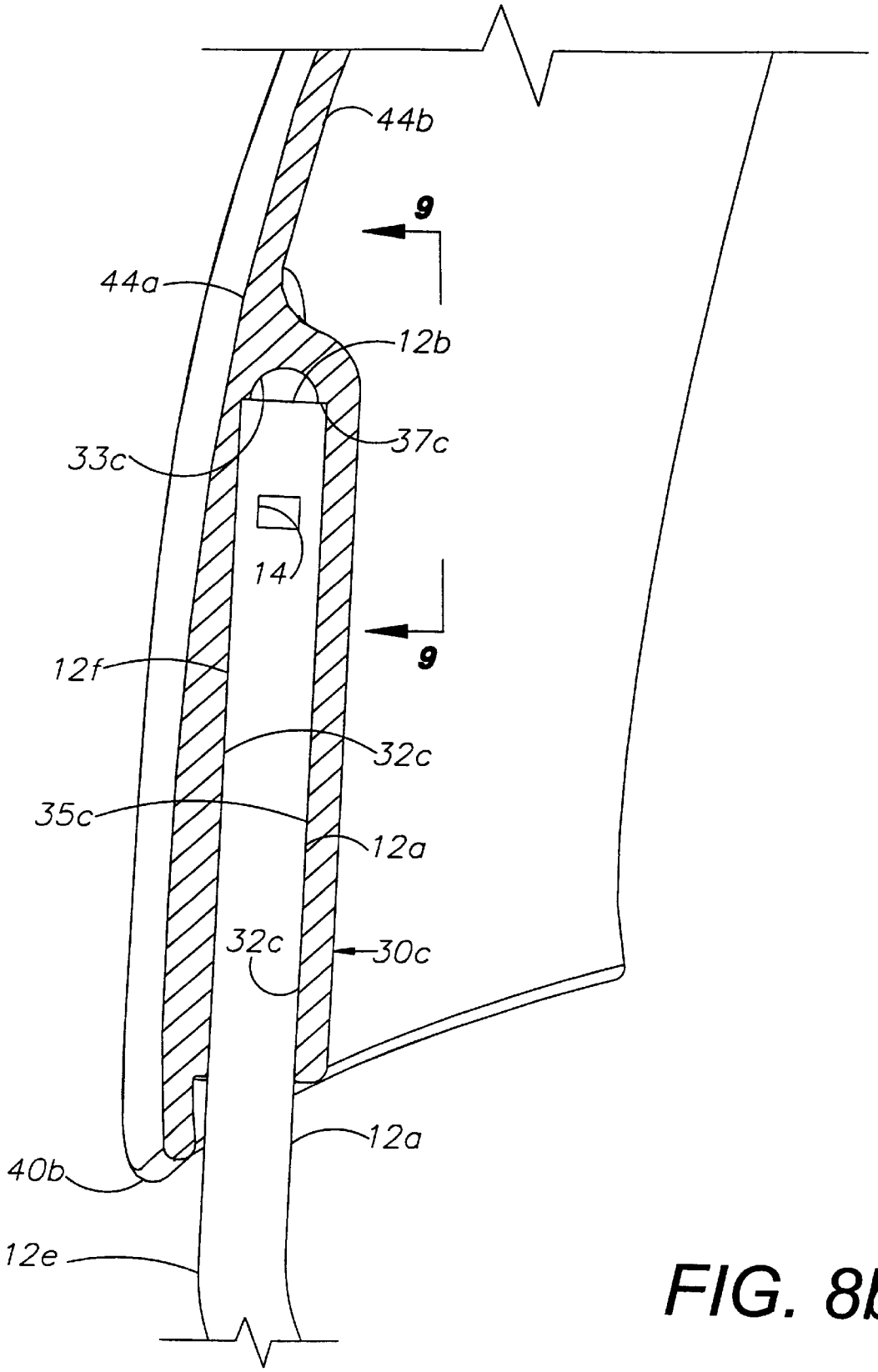
FIG. 8*b* is an enlarged, fragmentary, side elevational view thereof, generally showing the area marked 8*b* in FIG. 5.
Figure 11:
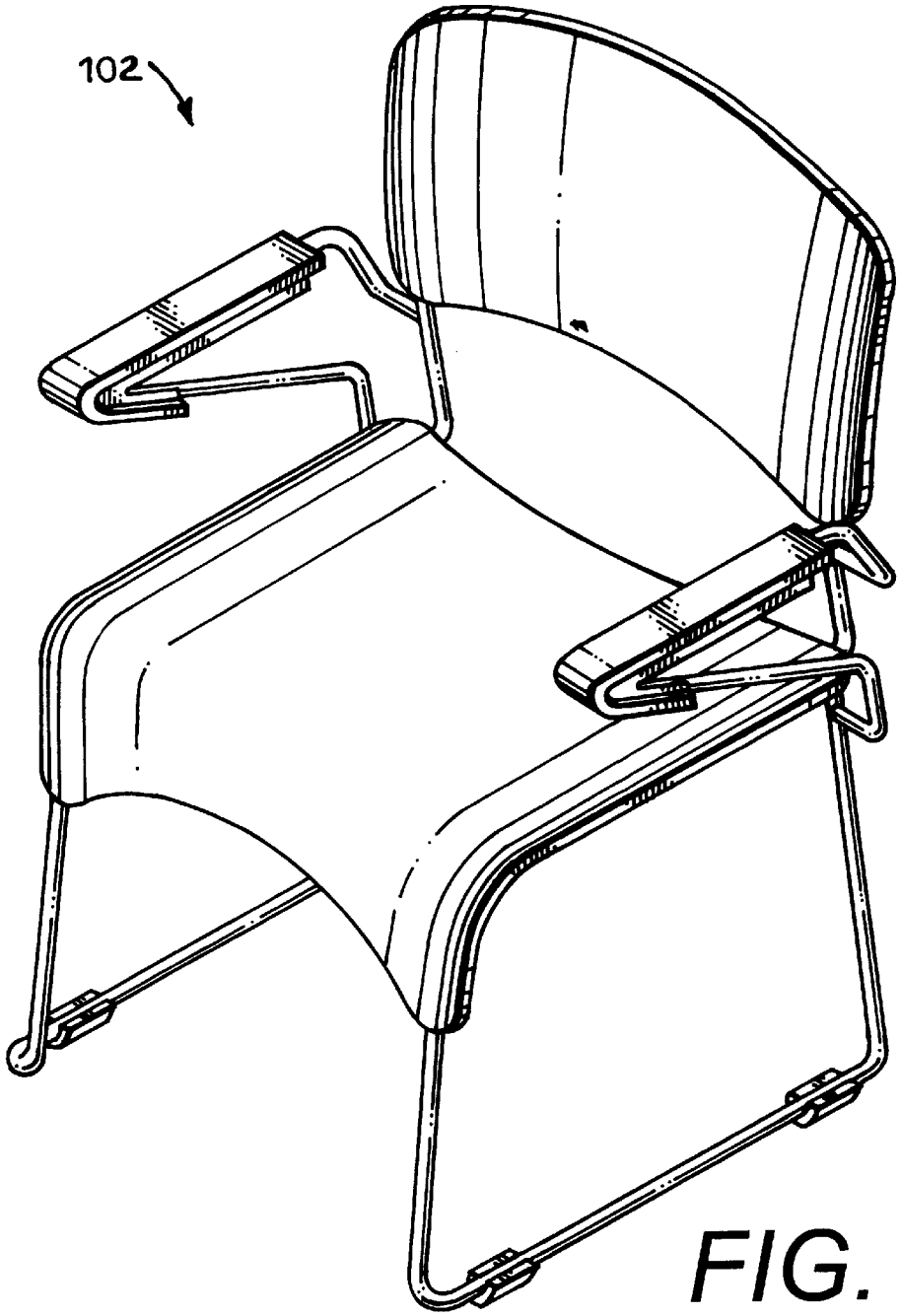
FIG. 11 is an upper, front perspective view of a frame-type armchair comprising a first modified embodiment of the present invention.
Figure 12:
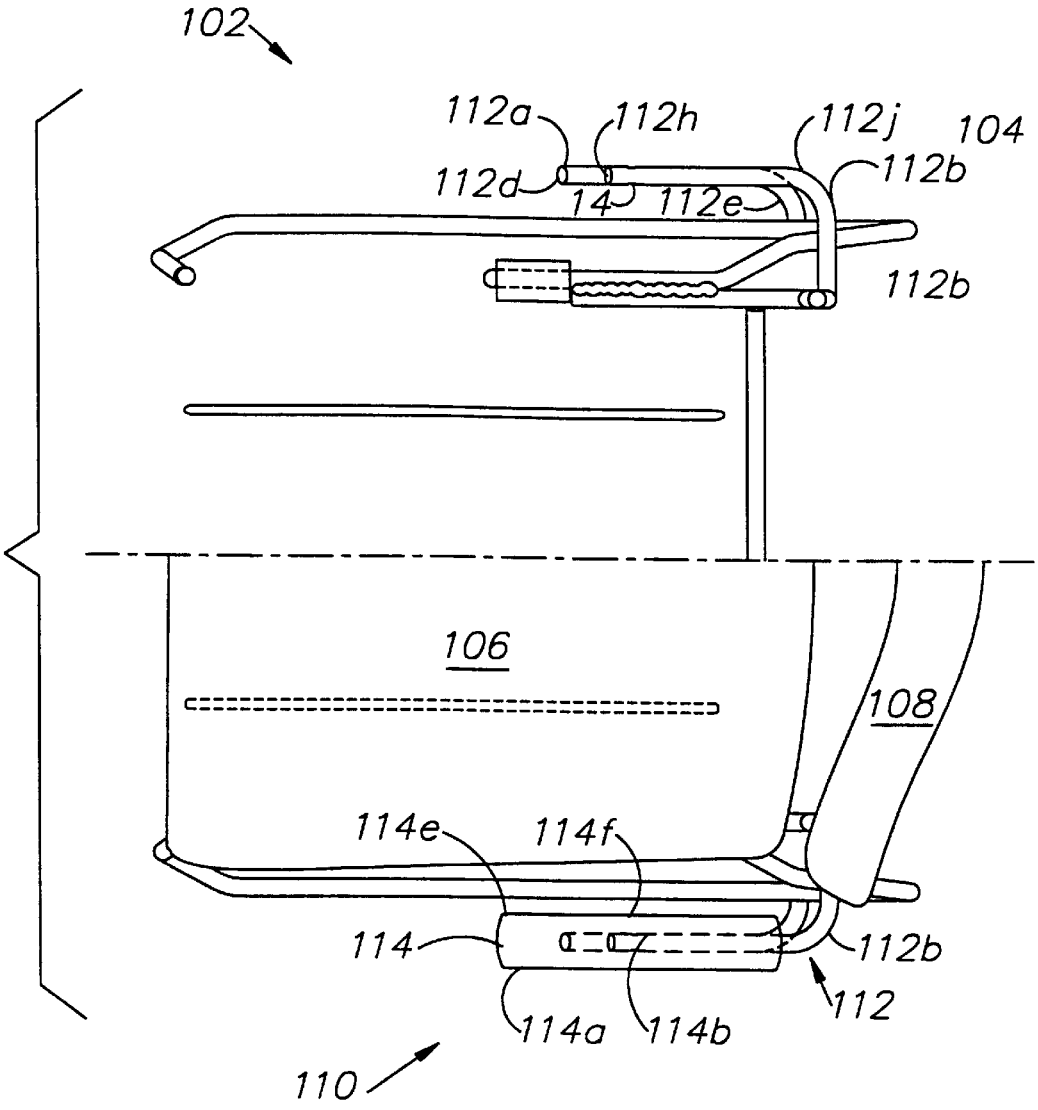
FIG. 12 is a top plan view thereof, with the upper half broken away to reveal the frame construction.
Figure 13:
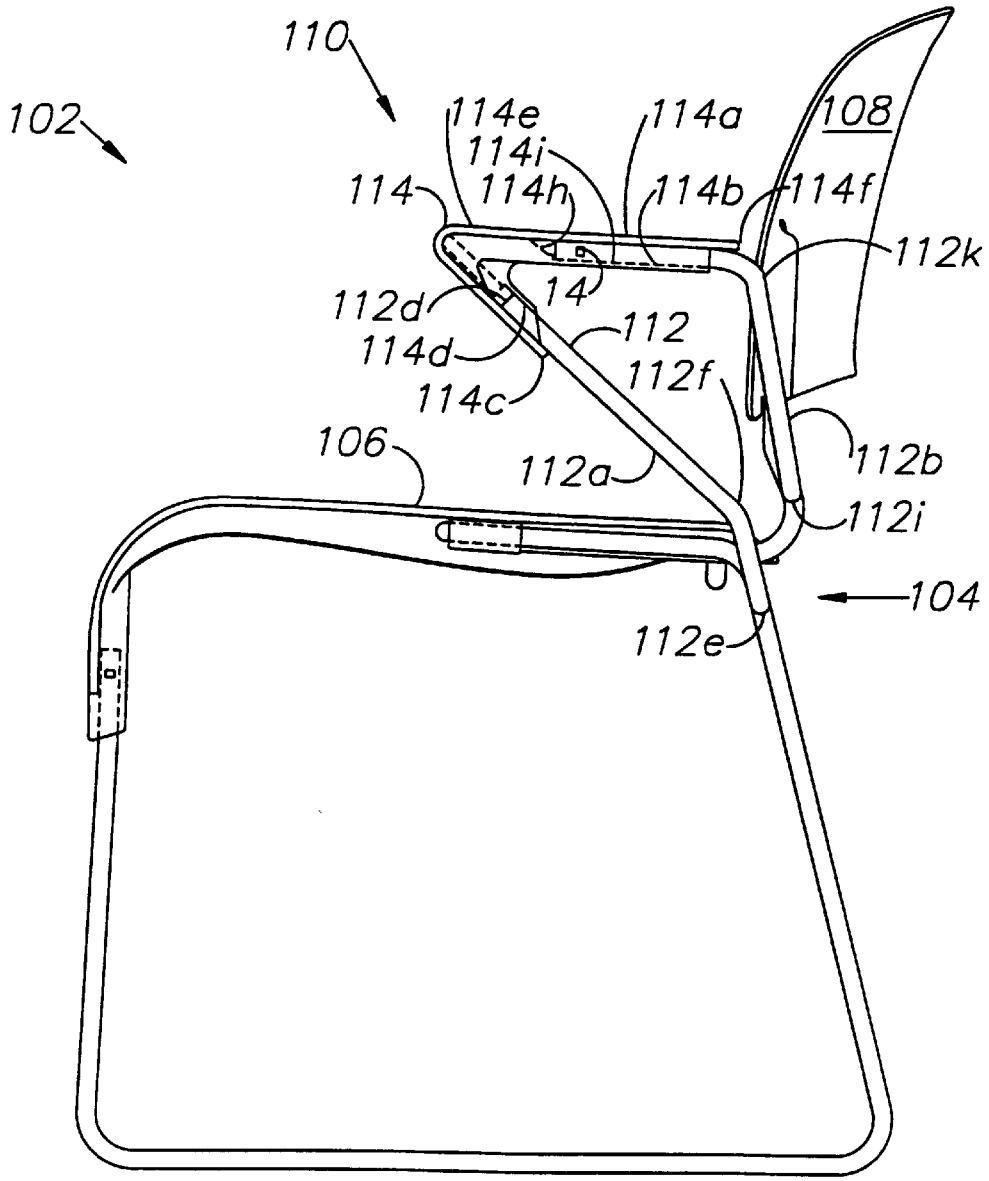
FIG. 13 is a side elevational view thereof.
Figure 14:
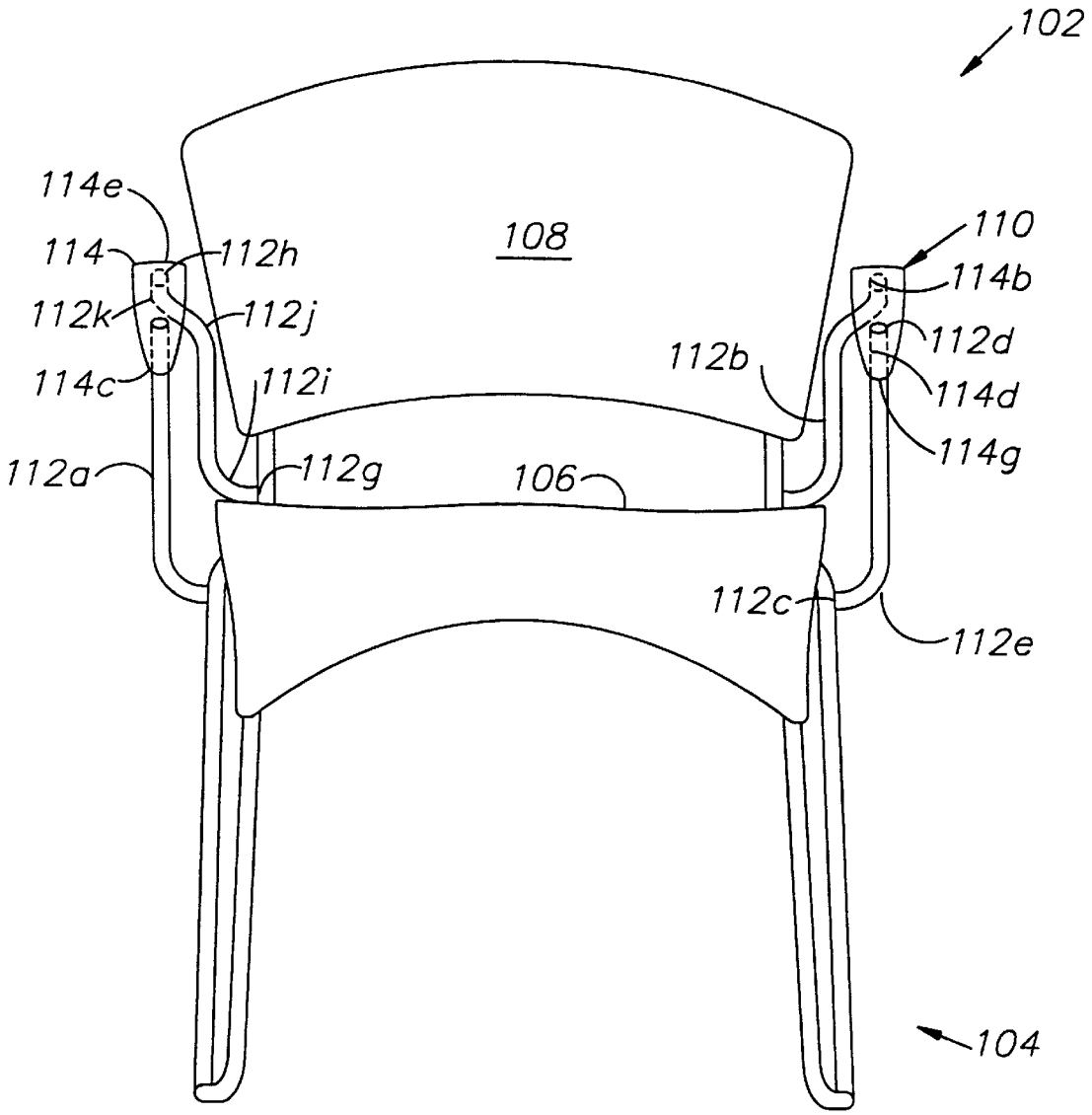
FIG. 14 is a front elevational view thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a frame-type chair embodying the present invention. The chair 2 generally comprises a bent-wire frame 4, a formed plastic seat 6 and a formed plastic back 8.

II. Frame 4

The frame 4 generally comprises a base subframe 10 and a back subframe 12. The base subframe 10 includes a pair of base subframe sides 10*a* each comprising front and back legs 10*b,c* and upper and lower longitudinal members 10*d,e*. The frame 4 can comprise, for example, relatively heavy-gauge wire, which can be suitably bent to desired configurations to provide sufficient strength and proper proportions.

The base subframe sides 10*a* can therefore each be bent from a single length of heavy-gauge wire whereby an upper rear corner 10*f* is formed at the intersection of the back leg 10*c* and the upper longitudinal member 10*d*; a lower front corner 10*g* is formed at the intersection of the front leg 10*b* and the lower longitudinal member 10*e*; and a lower rear corner 10*h* is formed at an intersection of the back leg 10*c* and the lower longitudinal member 10*e*. At the base subframe side upper rear corners 10*f* the upper longitudinal members 10*d* are offset inwardly from the back legs 10*c*. Similarly, at the lower front corners 10*g* the front legs 10*b* are offset inwardly from the lower longitudinal members 10*e*.

Each of the front legs 10*b* terminates at a base subframe front leg upper end 10*i*. Each upper longitudinal member 10*b* terminates at a rounded front end 10*j* positioned in spaced relation from a respective front leg upper end 10*i*. Each base subframe side 10*a* thus generally encloses a quadrangle, except for a gap 16 formed by the space between the base subframe ends 10*i*, 10*j*.

The front leg upper ends 10*i* have notches or skives at 14 for anchoring purposes which will be described in more detail hereinafter. The skives 14 are formed by suitably milling or stamping the frame member ends 10*i*. Although a particular skive configuration is shown, various other interference-type configurations could be used within the scope of the present invention. Such other configurations could comprise, for example, spiral, knurled, ribbed, etc.

The back subframe 12 includes a pair of back support members 12*a* each terminating at an upper end 12*b*. A pair of back subframe extensions 12*c* are connected to and extend forwardly from respective back support members 12*a* and terminate at front ends 12*h*. A crosspiece 12*d* extends between the extension members 12*c* and can be integrally connected to same by welding or by some other suitable connection means. The back subframe crosspiece 12*d* is downwardly-concave to accommodate the seat 6. The back subframe extension members 12*c* are preferably sized for placement inside of and adjacent to respective upper longitudinal members 10*d*.

Each back support member 12*a* includes a bend 12*e* whereat a rearwardly-open obtuse angle is formed by upper and lower back support member sections 12*f,g* respectively.

The base and back subframes 10, 12 are secured together by a pair of weldments 18 forming a connection between the upper longitudinal members 10*d* adjacent the base subframe upper rear corners 10*f* and the back subframe extension members 12*c*. The back subframe extension members 10*c* are preferably spaced to fit closely between the base subframe upper longitudinal members 10*d*. Chair glides 19 can be mounted on the lower longitudinal members 10*e*.

III. Seat 6

The seat 6 can be formed in different configurations from various suitable materials. For example, thermoplastic is suitable for many applications of the frame-type chair 2. The seat 6 includes a front 20; a back 22; opposite sides 24*a,b*; and upper and lower faces 26*a,b* respectively. An apron 28 extends transversely across the seat 6 at its front 20 between the seat sides 24*a,b* and includes an apron upper edge 28*a* forming a rounded brake 28*b* with the seat front 20 and an upwardly-convex, arcuate lower edge 28*c*. The apron 28 also includes front and back faces 28*d,e*.

The seat 6 includes a first pair of sockets 30*a* mounted on the apron back face 28*e* and protruding rearwardly therefrom in proximity to the seat sides 24*a,b*. Each first socket 30*a* includes a first socket receiver 32*a* comprising a receiver bore 33*a* and a receiver counterbore 35*a* separated by a receiver shoulder 37*a*. The receiver bores 33*a* can have diameters, for example, of approximately 0.25 inches and the receiver counterbores 35*a* can be enlarged to diameters of, for example, approximately 0.5 inches. The receiver counterbores 35*a* are thus sized to receive the front leg upper ends 10*i*, since the wire comprising the frame 4 can also have a nominal diameter of, for example, 0.5 inches. The front leg upper ends 10*i* abut the first socket receiver shoulders 37*a*, which function as stops to prevent the front leg upper ends 10*i* from passing into the reduced-diameter receiver bores 33*a*.

Without limitation on the generality of useful mounting arrangements for the frame 4 and the seat 6, a heat-stake connection can be employed by heating the front leg upper ends 10*i*, for example, with an induction heater coil to approximately 360°–400° F. The heated front leg upper ends 10*i* are then thrust into the socket receiver counterbores 35*a* to a point of refusal abutting the receiver shoulders 37*a*. The thermoplastic first sockets 30*a* are softened and partially melted by the heated front legs 10*i*. The first sockets 30*a* then reform over the skives 14 to form a relatively permanent, embedded mounting of the seat 6 on the base subframe 10.

A second pair of sockets 30*b* are mounted on the seat lower face 26*b* and depend downwardly therefrom in proximity to the seat sides 24*a,b* respectively. Each second socket 30*b* includes a constant-diameter receiver 32*b* extending therethrough and open at the ends thereof. Mounting the seat 6 on the base subframe 10 can be accomplished by heat-staking the front leg upper ends 10*i* in the first pair of sockets 30*a* and then flexing the frame 4 and/or the seat 6 to receive the upper longitudinal member front ends 10*j* in the second sockets 30*b*. The back subframe extension member front ends 12*h* abut the back ends of the second sockets 30*b* and thus function as stops for limiting the insertion of the upper longitudinal member front ends 10*j* into the second socket receivers 32*b*. The upper longitudinal member front ends 10*j* preferably protrude slightly forwardly from the second sockets 30*b*. With the seat 6 mounted on the frame 4, the base subframe 10 can be maintained in tension with a clamping force being exerted on the seat 6 at its sockets 30*a,b* for securely retaining the seat 6 on the base subframe 10. Thus, a relatively secure mounting of the seat 6 on the base subframe 10 is provided.

The seat 6 can be provided with suitable longitudinal ribs 34 depending downwardly from its lower face 26*b* and extending generally longitudinally for strengthening and reinforcing the seat 6.

IV. Back 8

The back 8 includes upper and lower edges 40*a,b* with upwardly-convex arcuate configurations. The back 8 also includes opposite side edges 42*a,b* which converge downwardly and front and back faces 44*a,b*. A third pair of sockets 30*c* project rearwardly from the back face 44*b* in proximity to the back side edges 42*a,b* respectively. The third pair of sockets 30*c* each includes a downwardly-open socket receiver 32*c* for receiving a respective support member upper end 12*b* in a heat stake relationship as described above. Each third socket receiver 32*c* includes a reduced-diameter third socket receiver bore 33*c* and an enlarged-diameter third socket counterbore 35*c* with a third socket shoulder 37*c* separating same.

V. First Modified Embodiment Frame-Type Chair 102 With Arms

A frame-type armchair 102 comprising a first modified embodiment of the present invention is shown in FIGS. 11–14. The armchair 102 includes a frame 104, a seat 106 and a back 108. The chair 102 includes a pair of arm assemblies 110. Otherwise it is generally similar to the chair 2 described above.

Each arm assembly 110 includes an arm frame subassembly 112 comprising front and back arm support members 112*a,b* respectively. The front arm support member 112*a* includes a proximate, lower end attached to the back leg 10*c* in proximity to the base subframe upper rear corner 10*f*. The front arm support member 10*a* extends generally upwardly and forwardly from its proximate end 112*c* to a distal end 112*d*. The front arm support member proximate end 112*c* is fixedly attached, e.g., by welding, to the back leg 10*c* and includes a lower elbow 112*e* which offsets the front arm support member 112*a* outwardly from the base subframe 10 to position the arm assembly 10 at an appropriate location. The front arm support member 112*a* also includes an upper elbow 112*f* in the range of approximately 30° to 60° from which the front arm support member 112*a* extends upwardly and forwardly at a sloping angle.

The back arm support member 112*b* includes a proximate, lower end 112*g* fixedly attached (e.g., by welding) to the lower portion 12*g* of a respective back subframe support member 12*a* and an upper, distal end 112*h* with a skive 14. The back arm support member 112*b* includes lower, intermediate and upper elbows 112*i,j,k* respectively which position the back arm support member distal end 112*b* behind and slightly above the front support member upper end 112*c* at a location offset slightly outwardly from the base subframe 10.

The arm assembly 110 includes an armrest 114, which includes a horizontal leg 114*a* with a rearwardly-open horizontal leg receiver 114*b* with a bore 114*h* and a counterbore 114*i* for receiving the back support member distal end 112*h*, for example, in a heat-stake relationship. The armrest 114 also includes a return leg 114*c* extending generally downwardly and rearwardly from the horizontal leg 114*a* and including a return leg receiver 114*d* which receives a respective front support member distal end 112*d*.

The armrest 114 includes a cover 114*e*, which can be formed integrally with the armrest 114*a,c*. The cover 114*e* includes a horizontal section 114*f* which generally overlies the horizontal leg 114*a* and a return section 114*g* located generally in front of the return leg 114*c*. The cover 114*e* is preferably configured and textured to provide a comfortable armrest for a person seated in the chair 102. Various types of padding and other materials could be applied to the cover 114*e* to achieve a desired effect.

VI. Second Modified Embodiment Frame-Type Chair 202 With Tablet Arm

Figure 15:
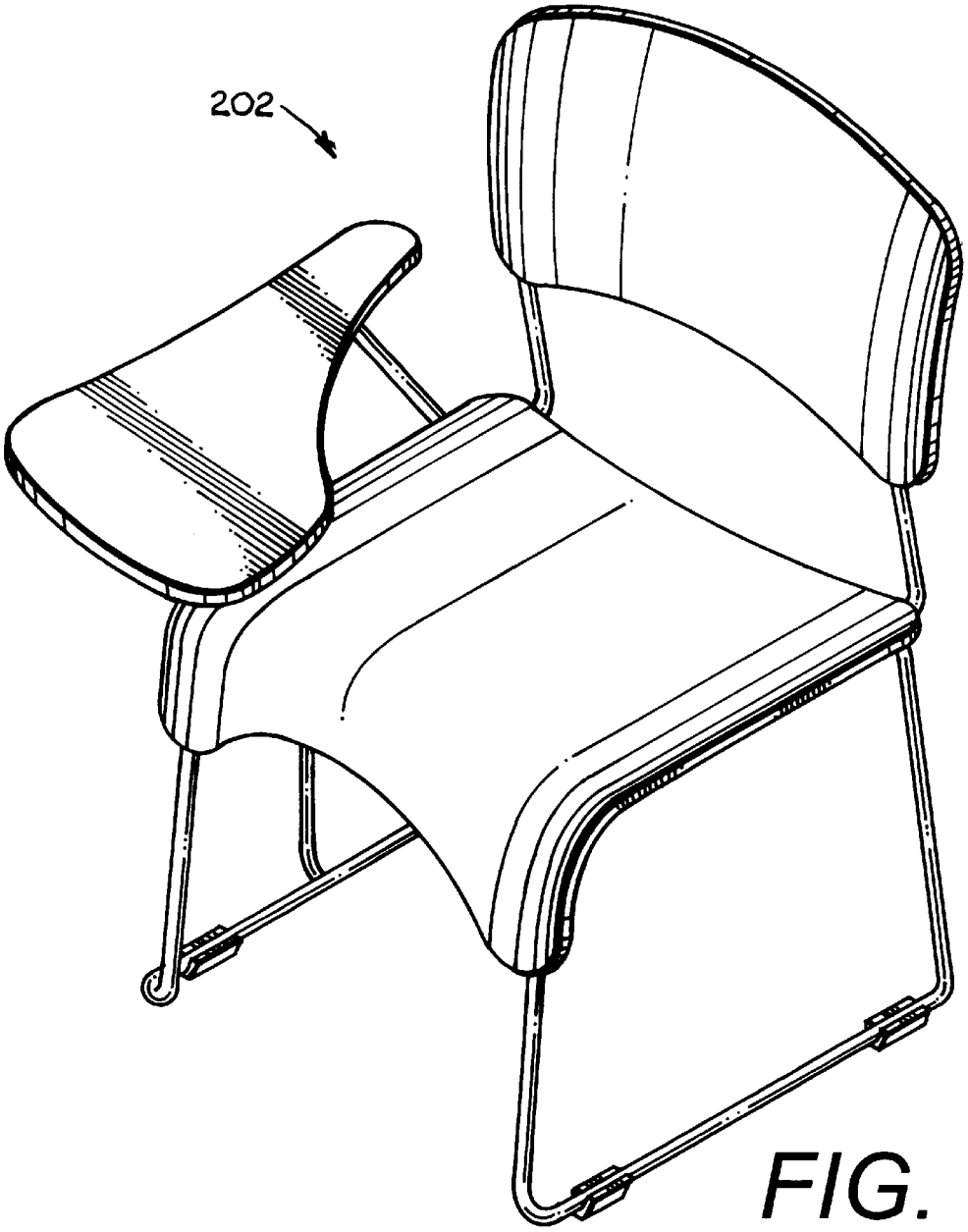
FIG. 15 is an upper, front perspective view of a frame-type tablet armchair, showing a second modified embodiment of the present invention.
Figure 16:
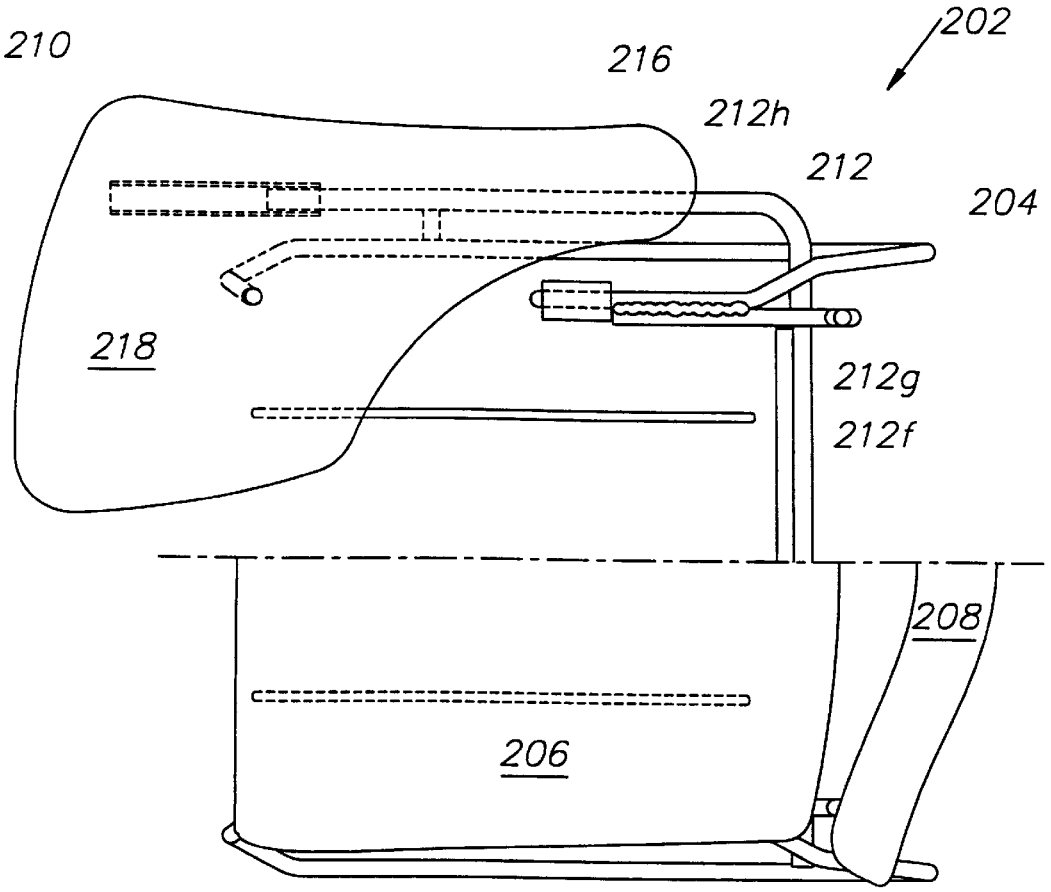
FIG. 16 is a top plan view thereof, with the upper half broken away to reveal frame construction.
Figure 17:
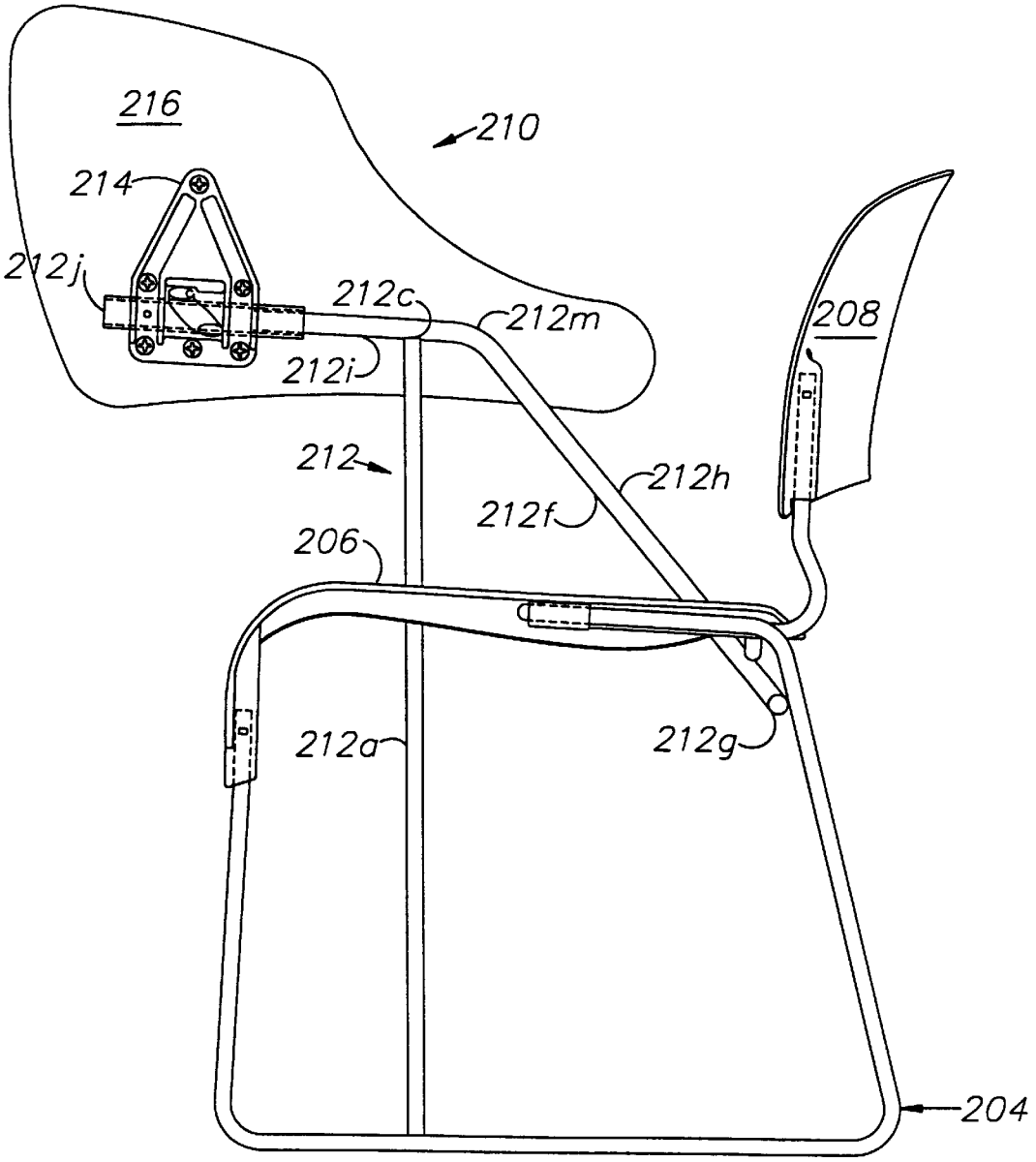
FIG. 17 is a side elevational view thereof.
Figure 18:
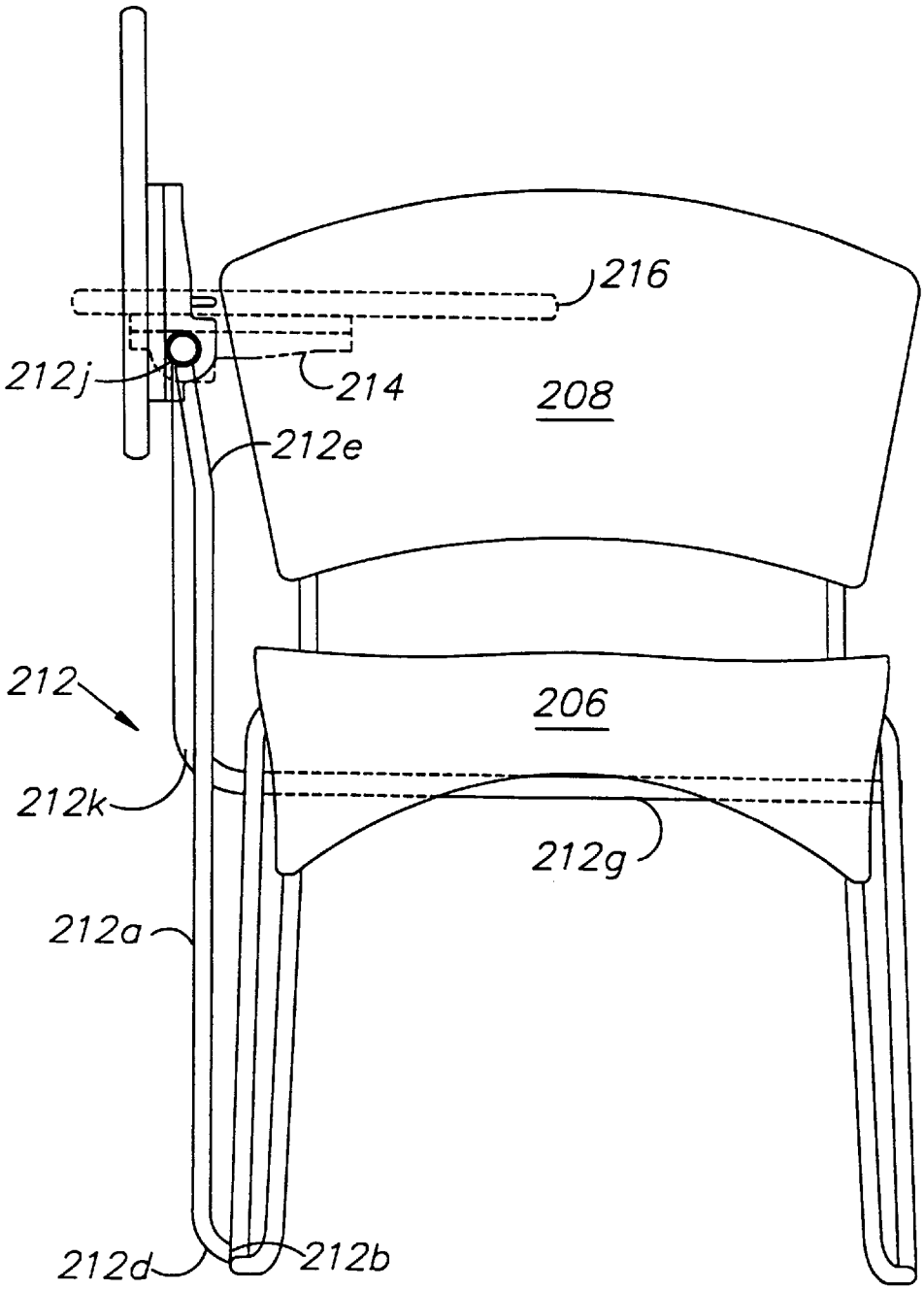
FIG. 18 is a front elevational view thereof.

A frame-type chair 202 comprising a second modified embodiment of the present invention is shown in FIGS. 15–17. The chair 202 includes a frame 204, a seat 206 and a back 208. The chair 202 is generally similar to the chair 2 described above, except that it includes a tablet arm assembly 210.

The tablet arm assembly 210 includes a tablet arm subframe 212 including a vertical leg 212*a* with a lower end 212*b* attached (e.g., by welding) to a respective base subframe lower longitudinal member 10*c* and an upper end 212*c*. The tablet arm leg 212*a* includes a lower elbow 212*d* and an upper elbow 212*e* which collectively locate the subframe leg upper end 212*c* at an appropriate position above a respective base subframe 10 and slightly offset outwardly therefrom.

The tablet arm subframe 212 further includes a tablet arm extension 212*f* comprising a crosspiece 212*g* extending between and connected to the frame back legs 10*c*, an intermediate section 212*h* extending generally forwardly and upwardly from the crosspiece 212*g* and an upper, generally horizontal section 212*i* extending generally forwardly from the intermediate section 212*h* and attached to the tablet arm leg upper end 212*c*. The tablet arm horizontal section 212*i* terminates at a front end 212*j*. The tablet arm subframe extension 212*f* includes a lower elbow 212*k* between the crosspiece and the intermediate sections 212*g,h* and an upper elbow 212*m* between the intermediate and horizontal sections 212*h,i*.

A tablet arm mounting bracket 214 is rotatably mounted on the tablet arm subframe horizontal extension 212*i* in proximity to its front end 212*j* for rotation through a range of approximately 90°–95°. A tablet arm 216 is mounted on the tablet arm mounting bracket. The tablet arm mounting bracket 214 and the tablet arm 216 are thus rotatable between a raised position slightly past vertical (FIG. 17, solid lines) to facilitate entry into and exit from the chair 202 and a lowered, use position (FIG. 17, dashed lines) whereat the tablet arm 216 is approximately horizontal, or slightly tilted at an appropriate writing angle (e.g., 10°–5°).

It is to be understood that while certain forms of the present invention have been illustrated and described herein, it is not to be limited to the specific forms or arrangement of parts described and shown.

What is claimed and desired to be secured by Letters Patent is as follows:

1. A chair comprising:

(a) a frame including a base subframe and a back subframe;

(b) said base subframe including a pair of base subframe sides each having:

(1) front and back legs;

(2) upper and lower longitudinal members;

(3) said back leg being connected to said upper horizontal member at an upper rear corner;

(4) said front leg being connected to said lower horizontal member at a lower front corner;

(5) said back leg being connected to said lower horizontal member at a lower rear corner;

(6) said front leg terminating at an upper end; and (7) said upper longitudinal member terminating at an upper longitudinal member end positioned in spaced relation from said front leg upper end;

(c) said back subframe having:

(1) a pair of back support members each having an upper end;

(2) a pair of back subframe extension members each connected to a back support member at a respective back support/extension member corner, each having a front end and each being positioned in parallel, adjacent relation to a respective upper longitudinal member and welded thereto on an inside of said upper longitudinal member, each of said back subframe extension member ends being positioned in spaced relation rearwardly from a respective upper longitudinal member end; and (3) a back subframe crosspiece extending between and connected to said extension members at said support/extension member corners;

(d) a seat including:

(1) a front;

(2) a back;

(3) opposite sides;

(4) an apron depending downwardly from said seat front and terminating at a lower apron edge below a level of said seat, said apron including front and rear faces;

(5) a rounded brake formed at an intersection of said seat front and said apron, said rounded brake extending transversely across said seat between the opposite sides thereof;

(6) a first pair of sockets in proximity to said seat opposite sides respectively;

(7) a second pair of sockets in proximity to said seat opposite sides respectively;

(8) said first pair of sockets each including a receiver receiving a respective front leg upper end in a heat stake relationship therein; and (9) said second pair of sockets each including a receiver slidably receiving a respective upper horizontal member end and each engaging a respective back subframe extension member end; and (e) a back including:

(1) a front face;

(2) a rear face;

(3) an upper edge;

(4) a lower edge;

(5) opposite sides; and (6) a third pair of sockets extending rearwardly from said back rear face and each including a receiver receiving a respective back support member upper end in a heat stake relationship therein.

* * * * *